US006439173B1

(12) United States Patent
Chung

(10) Patent No.: US 6,439,173 B1
(45) Date of Patent: Aug. 27, 2002

(54) INTERNAL COMBUSTION ENGINE WITH CYLINDER INSERT

(75) Inventor: Lee Wai Chung, El Cajon, CA (US)

(73) Assignee: Advanced Engine Breathing System, San Diego, CA (US)

( * ) Notice: Subject to any disclaimer, the term of this patent is extended or adjusted under 35 U.S.C. 154(b) by 0 days.

(21) Appl. No.: 09/716,197

(22) Filed: Nov. 17, 2000

(51) Int. Cl.[7] ..... F02F 1/10
(52) U.S. Cl. ..... 123/41.84; 123/193.2
(58) Field of Search ..... 123/41.83, 41.84, 123/193.2, 193.3

(56) References Cited

U.S. PATENT DOCUMENTS 2,721,542 A * 10/1955 Sheppard ..... 123/41.83
4,562,799 A * 1/1986 Woods et al. ..... 123/193.2
4,791,891 A * 12/1988 Kubis et al. ..... 123/41.84
5,582,144 A 12/1996 Mizutani
5,676,096 A 10/1997 Nishi et al.
6,079,375 A 6/2000 Duerr et al.
6,116,198 A 9/2000 Kirtley et al.

* cited by examiner

*Primary Examiner*—Noah P. Kamen

(57) ABSTRACT

An internal combustion engine includes an engine block having a head seat surface and a cylinder opening extending from the head seat surface into an interior of the engine block, and a cylinder insert residing within the cylinder opening and having an insert upper surface substantially flush with the head seat surface of the engine block. The cylinder insert has a smooth cylindrical inner surface with a longitudinally extending cylindrical axis, and a stepped outer surface formed of three longitudinal regions. The three longitudinal regions include a first longitudinal region adjacent to the insert upper surface and having a first wall thickness, a second longitudinal region remote from the first longitudinal region and having a second wall thickness less than the first wall thickness, and a third longitudinal region intermediate between and continuous with the first longitudinal region and the second longitudinal region. The third longitudinal region has a third wall thickness intermediate between the first wall thickness and the second wall thickness.

20 Claims, 2 Drawing Sheets

INTERNAL COMBUSTION ENGINE WITH CYLINDER INSERT

This invention relates to a cylinder insert structure used in an internal combustion engine such as an automotive engine.

BACKGROUND OF THE INVENTION

An internal combustion engine has an engine block with a number of cylinder openings therein. The pistons of the engine move within the cylinder openings in a reciprocating fashion. The pistons are driven downwardly by the appropriately timed combustion of a mixture of fuel and air in a combustion space between the top of each piston and the bottom of a cylinder head.

Some types of engine blocks are cast from aluminum-base alloys. The use of aluminum-base alloys rather than iron-base alloys reduces the weight of the engine because of the lower density of the aluminum-base alloys. The reduced weight improves the gas mileage of the vehicle.

The aluminum-base alloys work well for most of the engine block. However, they do not have sufficiently good strength and wear resistance at elevated temperatures to serve as the interior liner of the cylinder against which the piston slides and against which there is the combustion of the mixture of fuel and air. Several techniques have been used to improve the properties of the portion of the engine block that defines the cylinder openings. In one, that portion of the aluminum-base alloy is strengthened and/or hardened, as by the addition of alloying elements, coatings, or composite reinforcement.

In another approach that has generally gained the greatest acceptance, a cylinder liner of an iron-base alloy (e.g., steel or cast iron) is provided. A water jacket overlies the exterior of at least a part of the iron-base cylinder liner. To manufacture a cylinder block using an iron-base cylinder liner, the aluminum-base alloy is cast around iron-base cylinder liners already prepositioned within a mold.

This approach works well for many conventional uses of such engines. However, in other applications, such as a high-performance racing engine based on a modified stock engine block, the present inventor has observed that there are engine failures associated with the cylinder liner. There is a need for an approach to overcome these failures, while retaining the other advantageous features of the standard engine. The present invention fulfills this need, and further provides related advantages.

SUMMARY OF THE INVENTION

This invention provides an internal combustion engine with a cylinder insert that is not prone to failure in demanding applications. The cylinder insert is readily manufactured and is suited for use both in new construction and in the modification of conventional stock engines. It is compatible with the structure of conventional stock engine blocks, so that only minimal modifications of the conventional stock engine blocks are required to utilize the present cylinder insert. An engine with the engine block modified to use the present cylinder insert may be pushed to performance levels well in excess of those of conventional engine blocks without failures.

In accordance with the invention, an internal combustion engine includes an engine block having a head seat surface and a cylinder opening extending from the head seat surface into an interior of the engine block, and a cylinder insert residing within the cylinder opening and having an insert upper surface substantially flush with the head seat surface of the engine block. The cylinder insert has a smooth cylindrical inner surface with a longitudinally extending cylindrical axis, and a stepped outer surface formed of three longitudinal regions. The three longitudinal regions include a first longitudinal region adjacent to the insert upper surface and having a first wall thickness, a second longitudinal region remote from the first longitudinal region and having a second wall thickness less than the first wall thickness, and a third longitudinal region intermediate between and continuous with the first longitudinal region and the second longitudinal region. The third longitudinal region has a third wall thickness intermediate between the first wall thickness and the second wall thickness. Typically, there are at least two cylinder openings, and there is a cylinder insert as described above for each of the cylinder openings.

In an embodiment of most interest because it is well suited to the modification of an existing stock engine, an internal combustion engine includes an engine block having a head seat surface and a cylinder opening extending from the head scat surface into an interior of the engine block. The cylinder opening has a cylinder opening surface, and a cylinder opening cylindrical wall that is cylindrical about a longitudinally extending cylindrical axis and has a wall upper surface located at a recess depth below the head seat surface. The cylinder opening wall has a cylinder opening inner cylindrical diameter and a cylinder opening outer dimension such that there is a gap between the cylinder opening cylindrical wall and the cylinder opening surface. A cylinder insert resides within the cylinder opening and has an insert upper surface substantially flush with the head seat surface of the engine block. The cylinder insert comprises a smooth cylindrical inner surface that is cylindrical about the longitudinally extending cylindrical axis, and a stepped outer surface formed of three longitudinal regions. The outer surface includes a first longitudinal region adjacent to the insert upper surface and having a first wall thickness such that the first longitudinal region contacts the cylinder opening surface, and a second longitudinal region remote from the first longitudinal region and having a second wall thickness less than the first wall thickness, the second longitudinal region being received within the cylinder opening inner wall. There is a third longitudinal region intermediate between and continuous with the first longitudinal region and the second longitudinal region, the third longitudinal region having a third wall thickness intermediate between the first wall thickness and the second wall thickness. A support shoulder lies between the second longitudinal region and the third longitudinal region and rests upon the wall upper surface.

Desirably, the cylinder insert contacts the engine block in the first longitudinal region and the second longitudinal region, but does not contact the engine block in the third longitudinal region so that the gap is continued into this volume. Cooling water is circulated in the gap between the cylinder insert and the engine block.

The engine block preferably comprises an aluminum-base alloy and the cylinder insert preferably comprises an iron-base alloy such as a cast iron.

The cylinder insert of the invention has its thickest wall in the first region near the top of the cylinder opening. The greatest wall stresses in the cylinder insert are produced in this first region by the combustion of the mixture of fuel and air, requiring the greatest wall thickness. The first region need not have a great longitudinal length, because the magnitude of the combustion-induced stresses falls rapidly with increasing distance from the top of the cylinder and the insert top. The wall thickness of the cylinder insert is therefore reduced by reducing the outside diameter of the cylinder insert a short distance from the insert top. This reduction in the wall thickness of the cylinder insert provides both a shoulder for supporting the cylinder insert in the engine block and also decreases the thermal impedance to heat flow out of the insert wall and into the surrounding water jacket.

The invention is described herein as applied to one of the cylinders of an internal combustion engine. More commonly, the internal combustion engine has multiple cylinders, and a cylinder insert as described herein is provided for each of the cylinders.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
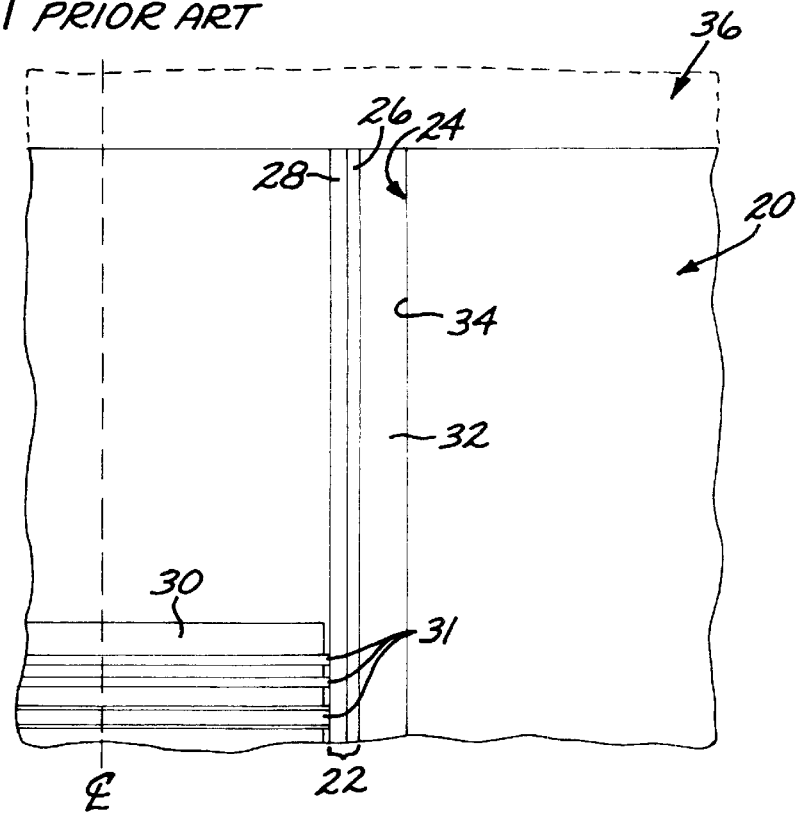
FIG. 1 PRIOR ART
FIG. 1 is a sectional view of a portion of an engine block and a conventional cylinder liner structure.

FIG. 1 depicts a portion of a conventional engine block 20 of an internal combustion engine, and a cylinder liner 22. The engine block 20, which is typically made of an aluminum-base alloy, has a bore 24 therein. The cylinder liner 22 is a composite structure having an outer layer 26 of an aluminum-base alloy (usually the same alloy as the remainder of the engine block 20) and an inner layer 28 of an iron-base alloy such as a nodular cast iron. A piston 30 moves in reciprocating movement within the interior of the cylinder liner 22 so that the piston rings 31 ride on the inner layer 28. Cooling water circulates through a gap 32 between the outer layer 26 and an interior surface 34 of the bore 24. A separate head structure 36, shown in phantom lines, is bolted onto the engine block 20 and seals both the interior of the cylinder and the gap 32.

This structure works well for many internal combustion engines. However, in some applications such as racing engines or other engines that require high performance operation, failures are observed in the relatively thin cylinder liner 22. The present invention, as described next, eliminates these failures.

Figure 2:
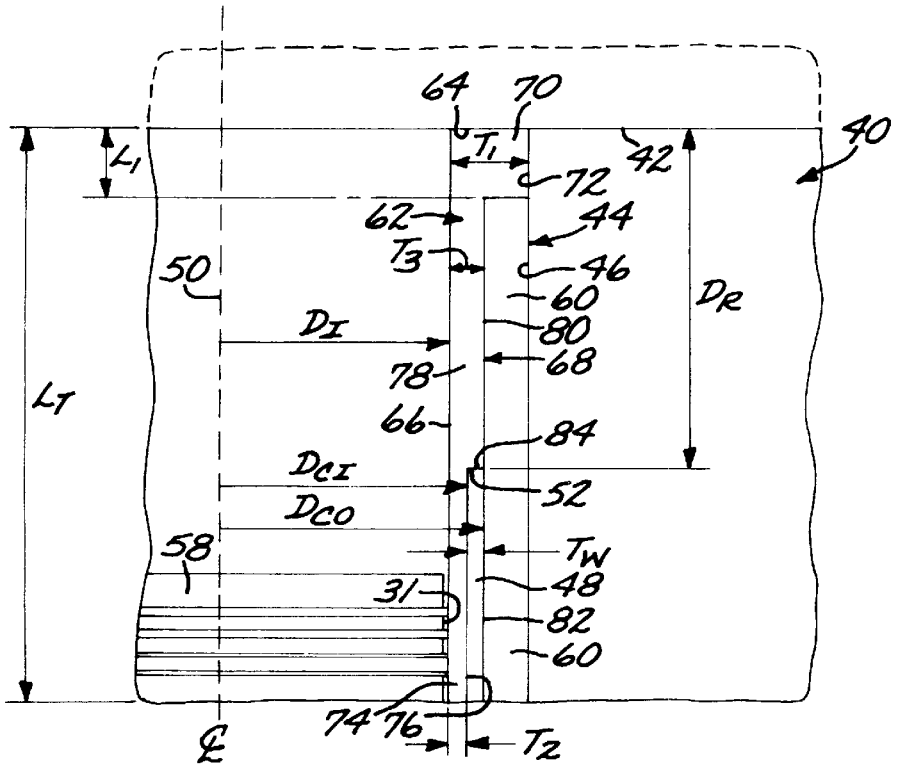
FIG. 2 is a sectional view of a portion of an engine block and a cylinder insert according to the invention.

FIG. 2 depicts a portion of an internal combustion engine including an engine block 40, preferably made of an aluminum-base alloy, having a head seat surface 42 and a cylinder opening 44 extending from the head seat surface 42 into an interior of the engine block 40. (As used herein, the terminology "X-base alloy" means that there is more of the element X than any other element in the alloy. Thus, an aluminum-base alloy has more aluminum than any other element, and an iron-base alloy has more iron than any other element.) The cylinder opening 44 has a cylinder opening surface 46 that is typically, but not necessarily, cylindrical. A cylinder opening cylindrical wall 48 is internally cylindrical about a longitudinally extending cylindrical axis 50, which in this case is coincident with the centerline of the cylinder opening 44. The cylinder opening cylindrical wall 48, sometimes termed the "cylindrical wall" herein, has a thickness of $T_W$. The cylindrical wall 48 has a wall upper surface 52 located at a recess depth $D_R$ below the head seat surface 42. The cylindrical wall 48 preferably is formed of an aluminum-base alloy (usually the same alloy as the remainder of the engine block 40). The cylinder opening cylindrical wall 48 has a cylinder opening inner cylindrical diameter $D_{CI}$ and a cylinder opening outer dimension $D_{CO}$ such that there is a gap 60 between the cylinder opening cylindrical wall 48 and the cylinder opening surface 46.

A cylinder insert 62 resides within the cylinder opening 44 and has an insert upper surface 64 substantially flush (i.e., coplanar) with the head seat surface 42 of the engine block 40. The cylinder insert 62 has a smooth cylindrical inner surface 66 that is cylindrical about the longitudinally extending cylindrical axis 50 and has a diameter $D_I$. A piston 58 moves in reciprocating movement within the interior of the cylindrical inner surface 66 so that the piston rings 31 ride on the cylindrical inner surface 66. The cylinder insert 62 is preferably made of an iron-base alloy such as steel or cast iron, and is most preferably a nodular cast iron having good wear resistance to the rubbing of the piston rings 31.

The cylinder insert 62 has a stepped outer surface 68 formed of three longitudinal regions. These regions include a first longitudinal region 70 adjacent to the insert upper surface 64 and having a first wall thickness $T_1$ such that an outwardly facing surface 72 of the first longitudinal region 70 contacts the cylinder opening surface 46. It is preferred that the outwardly facing surface 72 have a contacting interference fit to the cylinder opening surface 46. The interference fit may be achieved by making the outer diameter of the outwardly facing surface 72 from about 0.001 inch to about 0.004 inch smaller than the inner diameter of the cylinder opening surface 46. The outwardly facing surface 72 may be joined to the cylinder opening surface if desired, as for example by brazing, but such joining is typically not necessary with the interference fit.

A second longitudinal region 74 is remote from the first longitudinal region 70 and has a second wall thickness $T_2$ less than the first wall thickness $T_1$. The second longitudinal region 74 is received within the cylinder opening cylindrical wall 48 such that an outwardly facing surface 76 of the second longitudinal region 74 is in facing relation to the cylinder opening cylindrical wall 48. It is preferred that the second longitudinal region 74 have a contacting interference fit to the cylinder opening cylindrical wall 48. The interference fit may be achieved by making the outer diameter of the second longitudinal region 74 be from about 0.001 inch to about 0.004 inch smaller than the inner diameter of the cylinder opening cylindrical wall 48. The second longitudinal region 74 may be joined to the cylinder opening cylindrical wall 48 if desired, as for example by brazing, but such joining is typically not necessary with the interference fit.

A third longitudinal region 78 is intermediate between and continuous with the first longitudinal region 70 and the second longitudinal region 74. The third longitudinal region 78 has a third wall thickness $T_3$ intermediate between the first wall thickness $T_1$ and the second wall thickness $T_2$. Preferably, the third wall thickness $T_3$ is selected such that an outwardly facing surface 80 of the third longitudinal region 78 is of about the same outer diameter as an outwardly facing surface 82 of the cylinder opening cylindrical wall 48. That is, the sum of $T_2$ plus $T_W$ is about equal to $T_3$. With this construction, the gap 60 extends with a generally uniform width over the length of the cylinder opening cylindrical wall 48 and over the length of the third longitudinal region 78. In normal operation, a flow of cooling water is passed through this gap 60.

A right-angle support shoulder 84 is defined in the outer surface 68 of the cylinder insert 62 between the second longitudinal region 74 and the third longitudinal region 78. The support shoulder 84 rests upon the wall upper surface 52 to define the axial and radial positioning of the cylinder insert 62 relative to the wall upper surface 52 and the cylindrical wall 48.

The present approach places a great thickness $T_1$ of material in the first longitudinal region 70 of the cylinder insert 62. The inventor has observed that most failures of the cylinders of conventional engines occur near the very top of the cylinder liner, near the plane of the head seat surface. This localization of the failures is believed to find its origin in the fact that the combustion of the fuel and air mixture occurs at the very top of the cylinder, with resulting high pressures and thence circumferential forces in the wall. The circumferential wall forces fall very rapidly with increasing distance from the plane of the head seat surface 42. The first longitudinal region with its greater thickness of material to resist the circumferential combustion forces extends only a short distance in the longitudinal direction parallel to the axis 50. However, this increased thickness need not extend for a large distance parallel to the cylindrical axis 50.

Figure 3:
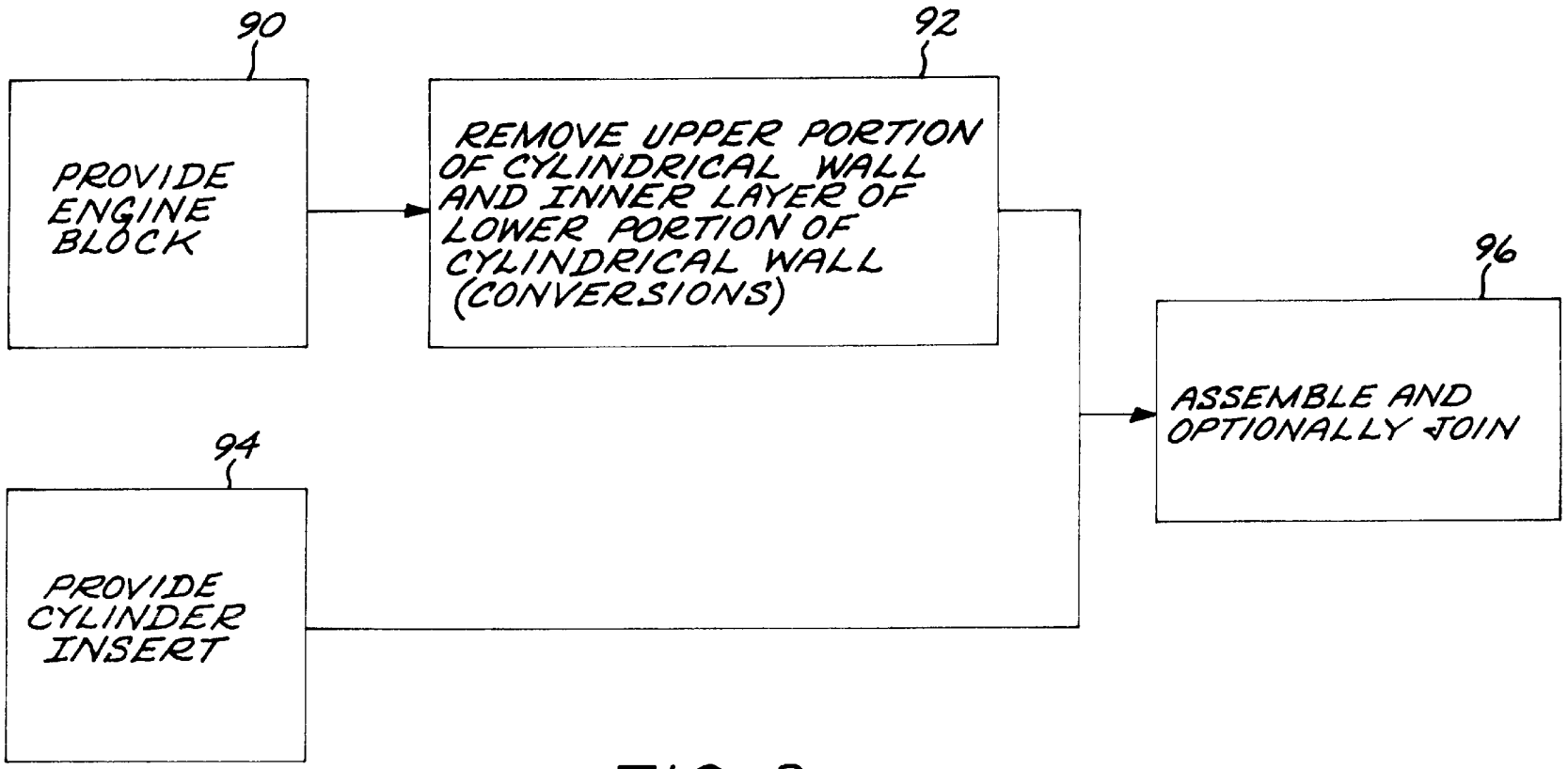
FIG. 3 is a block flow diagram of a preferred approach for practicing the invention by modifying a stock engine.

FIG. 3 is a block flow diagram of a preferred approach for practicing the invention. The engine block 40 is provided, numeral 90. The engine block 40 may be furnished with the structure described in relation to FIG. 2. The inventor converts stock engines to custom, high performance engines. In that case, the conventional stock engine block such as shown in FIG. 1 may be obtained and then altered, as by removing the upper portion of the cylinder liner 22 to the depth $D_R$ and also removing the remaining portion of the inner layer 28 (the steel or cast iron layer) in the lower portion of the cylindrical liner 22 that would otherwise face the second longitudinal region 74, numeral 92. The wall thickness $T_2$ of the second longitudinal region 74 of the cylinder insert 62 is made about the same as the thickness of the layer 28 that is removed, so that $D_1$ of the cylinder insert 62 is the same as the inner diameter of the cylinder liner 22 of the unmodified engine. The size of the piston used in the modified engine therefore remains unchanged. (Step 92 is required only for engine conversions. In using the present approach with an engine specifically designed for use with the cylinder insert 62, the engine block 40 is initially cast and machined with the configuration shown in FIG. 2.) The cylinder insert 62 structured as described above is provided, numeral 94. In a typical case, the cylinder insert 62 is cast from iron-base nodular cast iron alloy and then final machined. The cylinder insert 62 is assembled to the engine block 40, numeral 96.

The present invention has been reduced to practice by converting a stock engine block of a Honda and Acura 1.6–1.8 liter engine using the approach of FIG. 3. For that specific case, the dimensions of the cylinder insert 62 are a diameter $D_1$ about 3.386 inches, $T_1$ about 0.745 inch, $T_2$ about 0.119 inch, $T_3$ about 0.357 inch, $L_1$ about 0.5 inch, $D_R$ about 2½ inches, $L_T$ about 5.5 inches, and the total length of the first longitudinal region 70 plus the second longitudinal region 74 about 2½ inches. Cylinder inserts were prepared and used for the six cylinders of this engine. The engine was tested under a wide variety of conditions, and no failures of the cylinder inserts were observed.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An internal combustion engine including:

an engine block having a head seat surface and a cylinder opening extending from the head seat surface into an interior of the engine block, the cylinder opening having a cylinder opening surface, and a cylinder opening cylindrical wall that is cylindrical about a longitudinally extending cylindrical axis and has a wall upper surface located at a recess depth below the head seat surface, the cylinder opening wall having a cylinder opening inner cylindrical diameter and a cylinder opening outer dimension such that there is a gap between the cylinder opening cylindrical wall and the cylinder opening surface; and a cylinder insert residing within the cylinder opening and having an insert upper surface substantially flush with the head seat surface of the engine block, the cylinder insert comprising a smooth cylindrical inner surface with a longitudinally extending cylindrical axis, and a stepped outer surface formed of three longitudinal regions, the three longitudinal regions including a first longitudinal region adjacent to the insert upper surface and having a first wall thickness, a second longitudinal region remote from the first longitudinal region and having a second wall thickness less than the first wall thickness, the second longitudinal region being received within the inner cylindrical diameter of the cylinder opening wall, and a third longitudinal region intermediate between and continuous with the first longitudinal region and the second longitudinal region, the third longitudinal region having a third wall thickness intermediate between the first wall thickness and the second wall thickness.

2. The internal combustion engine of claim 1, wherein the engine block comprises an aluminum-base alloy and the cylinder insert comprises an iron-base alloy.

3. The internal combustion engine of claim 1, wherein the cylinder insert contacts the engine block in the first longitudinal region and the second longitudinal region, but does not contact the engine block in the third longitudinal region so that there is a gap between the cylinder insert and the engine block in the third longitudinal region.

4. The internal combustion engine of claim 1, wherein the engine block comprises at least two cylinder openings, and wherein there is a cylinder insert as set forth in claim 1 for each of the cylinder openings.

5. The internal combustion engine of claim 1, wherein each of the longitudinal regions is cylindrical about the cylindrical axis.

6. The internal combustion engine of claim 1, wherein the cylinder opening is cylindrical.

7. An internal combustion engine including:

an engine block having a head seat surface and a cylinder opening extending from the head seat surface into an interior of the engine block, the cylinder opening having a cylinder opening surface, and a cylinder opening cylindrical wall that is cylindrical about a longitudinally extending cylindrical axis and has a wall upper surface located at a recess depth below the head seat surface, the cylinder opening wall having a cylinder opening inner cylindrical diameter and a cylinder opening outer dimension such that there is a gap between the cylinder opening cylindrical wall and the cylinder opening surface; and a cylinder insert residing within the cylinder opening and having an insert upper surface substantially flush with the head seat surface of the engine block, the cylinder insert comprising a smooth cylindrical inner surface that is cylindrical about the longitudinally extending cylindrical axis, and a stepped outer surface formed of three longitudinal regions, the outer surface including a first longitudinal region adjacent to the insert upper surface and having a first wall thickness such that the first longitudinal region contacts the cylinder opening surface, a second longitudinal region remote from the first longitudinal region and having a second wall thickness less than the first wall thickness, the second longitudinal region being received within the cylinder opening inner wall, a third longitudinal region intermediate between and continuous with the first longitudinal region and the second longitudinal region, the third longitudinal region having a third wall thickness intermediate between the first wall thickness and the second wall thickness, and a support shoulder between the second longitudinal region and the third longitudinal region, the support shoulder resting upon the wall upper surface.

8. The internal combustion engine of claim 7, wherein the engine block comprises an aluminum-base alloy and the cylinder insert comprises an iron-base alloy.

9. The internal combustion engine of claim 7, wherein the cylinder insert contacts the engine block in the first longitudinal region and the second longitudinal region, but does not contact the engine block in the third longitudinal region.

10. The internal combustion engine of claim 7, wherein the engine block comprises at least two cylinder openings, and wherein there is a cylinder insert as set forth in claim 6 for each of the cylinder openings.

11. The internal combustion engine of claim 7, wherein the first longitudinal region is joined to the cylinder opening surface and the second longitudinal region is joined to the cylinder opening inner wall.

12. The internal combustion engine of claim 7, wherein each of the longitudinal regions is cylindrical about the cylindrical axis.

13. The internal combustion engine of claim 6, wherein the cylinder opening is cylindrical.

14. An internal combustion engine including:

an engine block having a head seat surface and a cylinder opening extending from the head seat surface into an interior of the engine block, the cylinder opening having a cylinder opening surface, and a cylinder opening cylindrical wall that is cylindrical about a longitudinally extending cylindrical axis and has a wall upper surface located at a recess depth below the head seat surface, the cylinder opening wall having a cylinder opening inner cylindrical diameter and a cylinder opening outer dimension such that there is a gap between the cylinder opening cylindrical wall and the cylinder opening surface; and a cylinder insert residing within the cylinder opening and having an insert upper surface substantially flush with the head seat surface of the engine block, the cylinder insert comprising a smooth cylindrical inner surface that is cylindrical about the longitudinally extending cylindrical axis, and a stepped outer surface formed of three longitudinal regions, the outer surface including a first longitudinal region adjacent to the insert upper surface and having a first wall thickness such that the first longitudinal region contacts the cylinder opening surface, a second longitudinal region remote from the first longitudinal region and having a second wall thickness less than the first wall thickness, the second longitudinal region being received within the cylinder opening inner wall, a third longitudinal region intermediate between and continuous with the first longitudinal region and the second longitudinal region, the third longitudinal region having a third wall thickness intermediate between the first wall thickness and the second wall thickness, and a support shoulder between the second longitudinal region and the third longitudinal region, the support shoulder resting upon the wall upper surface, wherein the gap serves as a water-cooling jacket extending over a length of the second longitudinal region and a length of the third longitudinal region.

15. The internal combustion engine of claim 14, wherein the engine block comprises an aluminum-base alloy and the cylinder insert comprises an iron-base alloy.

16. The internal combustion engine of claim 14, wherein the cylinder insert contacts the engine block in the first longitudinal region and the second longitudinal region, but does not contact the engine block in the third longitudinal region.

17. The internal combustion engine of claim 14, wherein the engine block comprises at least two cylinder openings, and wherein there is a cylinder insert as set forth in claim 14 for each of the cylinder openings.

18. The internal combustion engine of claim 14, wherein the first longitudinal region is joined to the cylinder opening surface and the second longitudinal region is joined to the cylinder opening inner wall.

19. The internal combustion engine of claim 14, wherein each of the longitudinal regions is cylindrical about the cylindrical axis.

20. The internal combustion engine of claim 14, wherein the cylinder opening is cylindrical.

* * * * *